US008632028B2

(12) United States Patent
Euculano

(10) Patent No.: US 8,632,028 B2
(45) Date of Patent: Jan. 21, 2014

(54) DEVICE FOR THE COMMINUTION OF MATERIAL

(75) Inventor: Jason Steven Euculano, Northampton, PA (US)

(73) Assignee: FLSmidth A/S (DK)

( * ) Notice: Subject to any disclaimer, the term of this patent is extended or adjusted under 35 U.S.C. 154(b) by 467 days.

(21) Appl. No.: 12/874,327

(22) Filed: Sep. 2, 2010

(65) Prior Publication Data

US 2012/0056027 A1 Mar. 8, 2012

(51) Int. Cl.
*B02C 4/32* (2006.01)

(52) U.S. Cl.
USPC ..... 241/231

(58) Field of Classification Search
USPC ..... 241/230–234, 235, 236
See application file for complete search history.

(56) References Cited

U.S. PATENT DOCUMENTS

| | | | |
|---|---|---|---|
| 880,035 | A | 2/1908 | Neilsen |
| 4,484,879 | A | 11/1984 | Heinz |
| 4,838,156 | A | 6/1989 | Hafner |
| 4,905,910 | A | 3/1990 | Wuestner |
| 5,192,030 | A | 3/1993 | Jakobs |
| 5,211,108 | A | 5/1993 | Gore |
| 5,354,002 | A | 10/1994 | Folsberg |
| 5,405,091 | A | 4/1995 | Folsberg |
| 5,454,520 | A | 10/1995 | Folsberg |
| 5,505,389 | A | 4/1996 | Sussegger |
| 5,601,242 | A | 2/1997 | Andersen |
| 5,918,823 | A | 7/1999 | Strasser |
| 7,028,934 | B2 | 4/2006 | Burynski, Jr. |
| 7,637,446 | B2 | 12/2009 | Euculano |
| 2009/0236455 | A1 | 9/2009 | Strasser |
| 2009/0314868 | A1 | 12/2009 | Frangenberg et al. |

FOREIGN PATENT DOCUMENTS

| | | | |
|---|---|---|---|
| FR | 1462789 | A | 2/1967 |
| GB | 2116072 | A | 9/1983 |

OTHER PUBLICATIONS

ISR and Written Opinion mailed Dec. 13, 2011.

*Primary Examiner* — Mark Rosenbaum
(74) *Attorney, Agent, or Firm* — Jeffrey A. Sharp; Aaron M. Pile; Daniel DeJoseph

(57) ABSTRACT

A device for comminuting material, such as a roller press, includes rollers positioned adjacent to each other and forming a nip therebetween. One of the rollers may be moveable via an actuator, such as a cylinder or hydraulic cylinder. One or more first accumulators may be attached to the actuator so that fluid is moveable from the actuator to the one or more first accumulators when the rollers are rotated to comminute material passing through the nip. One or more second accumulators may be connected to the actuator as well so that fluid from the actuator may move to the one or more second accumulators when an uncrushable element passes through the nip. Preferably, the one or more second accumulators are configured such that fluid does not pass from the actuator to the one or more second accumulators unless an uncrushable element passes through the nip.

15 Claims, 4 Drawing Sheets

DEVICE FOR THE COMMINUTION OF MATERIAL

FIELD OF THE INVENTION

The present invention relates to devices that comminute material such as roller presses.

BACKGROUND OF THE INVENTION

Roller presses include a stationary roller and a second moveable roller. The stationary and moveable rollers are spaced apart from each other to define a nip between the rollers. The rollers are rotated to comminute material that may pass through the nip. The second moveable roller may be moveable away from the first roller to widen the nip and may be moveable closer to the roller to narrow the nip. Examples of roller presses may be appreciated from U.S. Pat. Nos. 880,035, 4,484,879, 4,838,156, 4,905,910, 5,192,030, 5,211,108 5,354,002, 5,405,091, 5,454,520, 5,505,389, 5,601,242, and 5,918,823 and U.S. Patent Application Publication Nos. 2009/0314868 and 2009/0236455.

A hydraulic cylinder may be attached to the moveable roller to move the roller for widening and narrowing the nip. The cylinder may also be configured to help maintain a width of the nip for the comminution of material when the rollers are comminuting crushable material. A fluid such as oil may be used to adjust the position of a piston of the hydraulic cylinder for moving the second roller. The fluid of the hydraulic cylinder may have a pressure set point that affects the positioning of the second roller when a roller press is moving to comminute material.

Roller presses are often configured so that the moveable roller moves to widen the nip when an uncrushable element passes through the nip. Such movement is often in response to the large pressure created by the rollers attempting to comminute the uncrushable element. Often, a relief valve is required to be opened to relieve the build up of pressure that occurs within the hydraulic cylinder that may result form such an occurrence. When the relief valve is opened, fluid may pass from the hydraulic cylinder to a storage tank to reduce the pressure within the hydraulic cylinder and other components of the roller press.

The relief valves often have to be relatively large for effectively reducing the build-up of pressure that may result from the presence of an uncrushable element passing through the nip. Such large relief valves are generally expensive and add a significant amount of cost to roller presses.

Moreover, there is typically a delay between when an uncrushable element passes through the nip and when the relief valve is opened to release the increased pressure that is created as a result of the presence of the uncrushable element. The components of the roller press experience the substantial increased pressure during this delay, which may increase the wear experienced by components of the roller press, reduce the life of the components of the roller press, and increase the time and expense required to maintain the roller press.

A new roller press is needed that may permit an elimination or significant reduction in the pressure experienced by components of the roller press while waiting for a relief valve to open to relieve a pressure increase that may result when an uncrushable element passes through the nip of a roller press. Preferably, such a roller press is configured to permit use of a relatively small relief valve, which may help reduce the cost of manufacturing such a roller press. The new roller press preferably includes design features that may also be utilized in other devices configured to comminute material such as vertical mills or roller mills.

SUMMARY OF THE INVENTION

A device sized and configured to comminute materials may include a frame, a first roller attached to the frame and a second roller positioned adjacent to the first roller such that a nip is formed between the first and second rollers. The first and second rollers may be rotatable to comminute material that passes through the nip. An actuator may be attached between the second roller and the frame. The actuator may have a moveable element attached to the second roller and a fluid. The fluid is moveable to move the moveable element for adjusting a position of the second roller relative to the first roller. One or more first accumulators may be connected to the actuator so that at least a portion of the fluid is moveable from the actuator to the one or more first accumulators when the first and second rollers are rotated to comminute crushable material. The second roller is configured to move away from the first roller when fluid moves from the actuator to the one or more first accumulator to widen the nip and the second roller is configured to move toward the first roller to narrow the nip via the actuator. Such narrowing of the nip may occur, for example, when fluid moves from the one or more first accumulators to the actuator. One or more second accumulators may also be connected to the actuator such that at least a portion of the fluid is moveable from the actuator to the one or more second accumulators when an uncrushable element passes through the nip. The one or more second accumulators may be set such that the one or more second accumulators are isolated from the actuator and at least one first accumulator until an uncrushable element passes through the nip Preferably, the one or more second accumulators are configured such that no portion of the fluid of the actuator is moved to the one or more second accumulators when the crushable material is being comminuted and an uncrushable element is not passing through the nip. The second roller may be configured to move away from the first roller to widen the nip when fluid moves from the actuator to the one or more second accumulators.

It should be understood that embodiments of the device may include any of a plurality of types of accumulators that may be suitable for a particular design objection. For instance, types of accumulators that may be used may be hydro-pneumatic accumulators, piston accumulators, gas charged bladder accumulators, gas charged piston accumulators, spring loaded piston accumulators, weight loaded accumulators, or gas valve accumulators.

It is contemplated that embodiments of the device may include roller mills, vertical mills or other comminution devices. For such embodiments, the first roller may be a rotatable table or other rotatable element and the nip may be spacing that exists between that rotatable element and the second roller.

Some embodiments of the device may also include a fluid storage tank connected to the actuator to receive fluid from the actuator. Fluid stored in the fluid storage tank may be moveable from the fluid storage tank to the actuator as well. A relief valve may also be positioned between the actuator and the fluid storage tank. The relief valve may be configured to move to an open position to permit fluid to flow to the fluid storage tank when the uncrushable element is detected as being within the nip. The relief valve may also be moveable to a closed position when the uncrushable element is not present within the nip so fluid does not flow to the fluid storage tank.

Embodiments of the device may also utilize a pump connected to the fluid storage tank to move fluid stored in the storage tank toward the actuator. The pump may be configured to be activated after at least a portion of the fluid from the actuator has been received by the fluid storage tank via the relief valve so that the fluid stored in the storage tank is moved to the actuator after the uncrushable element has passed through the nip.

A control valve may be connected to the pump to control pump operations or control the flow of fluid that may be moved via the pump in some embodiments of the device. The control valve may be moveable from a closed position to an open position. Fluid stored in the fluid storage tank may be moveable from the fluid storage tank to the actuator when the control valve is in the open position and the fluid may not be moveable from the fluid storage tank to the actuator when the control valve is in the closed position.

An embodiment of the device may be a roller press. Embodiments of the roller press may include a first roller attached to a frame and a second roller that is positioned adjacent to the first roller such that a nip is formed between the first and second rollers. A cylinder may moveably attach the second roller to the frame. The cylinder may include a moveable element attached to the second roller and a fluid that is moveable to move the moveable element for adjusting a position of the second roller relative to the first roller. At least one first accumulator may be connected to the cylinder so that at least a portion of the fluid is moveable from the cylinder to the one or more first accumulators when the first and second rollers are rotated to comminute crushable material. One or more second accumulators may be connected to the cylinder so that at least a portion of the fluid is moveable from the cylinder to the one or more second accumulators when an uncrushable elements passes through the nip. Fluid is not moved from the cylinder to the one or more second accumulators when the crushable material is being comminuted and an uncrushable element is not passing through the nip.

It should be appreciated that the crushable material may be ore, rock, minerals, stone, agglomerated material, or combinations thereof. The one or more first accumulators may be one or more hydraulic accumulators. The one or more second accumulators may be one or more hydraulic accumulators. The cylinder may be a hydraulic cylinder.

The second roller of the roller press may be configured to move away from the first roller to widen the nip via the cylinder and may also be configured to move toward the first roller to narrow the nip via the cylinder. The moveable element of the cylinder may move via movement of the fluid into the cylinder or away from the cylinder toward the one or more first accumulators, one or more second accumulators, fluid storage tank, or combinations thereof.

Embodiments of the roller press may also include multiple sets of rollers. For instance one embodiment may include a third roller and a fourth roller positioned adjacent to the third roller to form a nip between the third and fourth rollers. A second cylinder may moveably attach the fourth roller to the frame of the roller press. One or more third accumulators may be connected to the second cylinder and one or more fourth accumulators may also be connected to the cylinder. Fluid may be moveable from the second hydraulic cylinder to the one or more fourth accumulators when an uncrushable element passes through the nip between the third and fourth rollers. The fluid of the second cylinder may not be moveable from the second cylinder to the one or more fourth accumulators when the crushable material is being comminuted and an uncrushable element is not passing through the nip between the third and fourth rollers.

Yet other embodiments of the device may include roller presses that include a frame, a first roller attached to the frame, and a second roller positioned adjacent to the first roller such that a nip is formed between the first and second rollers. The first and second rollers are rotatable to comminute material that passes through the nip. A hydraulic cylinder is also included in the roller press. The hydraulic cylinder has a moveable element attached to the second roller and a fluid. The fluid is moveable to move the moveable element for adjusting a position of the second roller relative to the first roller. The hydraulic cylinder is at a first pressure setting. At least one first accumulator is connected to the hydraulic cylinder. The at least one first accumulator is set at a second pressure setting that is below the first pressure setting of the hydraulic cylinder. At least one second accumulator is also connected to the hydraulic cylinder. The at least one second accumulator is at a third pressure setting that is greater than the first pressure setting of the hydraulic cylinder and is greater than the second pressure setting of the at least one first accumulator.

Preferably, the second pressure setting is between 10% and 30% lower than the first pressure setting and the third pressure setting is between 10% and 30% higher than the first pressure setting.

Embodiments of the roller press may also include a third roller attached to the frame; a fourth roller positioned adjacent to the third roller such that a nip is formed between the third and fourth rollers, and a second hydraulic cylinder. The second hydraulic cylinder has a moveable element attached to the fourth roller and a fluid. The fluid is moveable to move the moveable element of the second cylinder for adjusting a position of the fourth roller relative to the third roller. The second hydraulic cylinder is at a fourth pressure setting. At least one third accumulator is connected to the second hydraulic cylinder. The at least one second accumulator is set at a fifth pressure setting that is below the fourth pressure setting of the second hydraulic cylinder. At least one fourth accumulator is connected to the second hydraulic cylinder. The at least one fourth accumulator is at a sixth pressure setting that is greater than the fourth pressure setting of the second hydraulic cylinder and is greater than the fifth pressure setting of the at least one third accumulator.

Preferably, the third pressure setting is equal to the first pressure setting, the second pressure setting is equal to the fifth pressure setting, and the third pressure setting is equal to the sixth pressure setting.

It should be appreciated that the at least one fourth accumulator may also be connected to the at least one second accumulator.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of devices configured for the comminution of material and methods of making and using the same are shown in the accompanying drawings.

DETAILED DESCRIPTION OF PRESENT PREFERRED EMBODIMENTS

Figure 1:
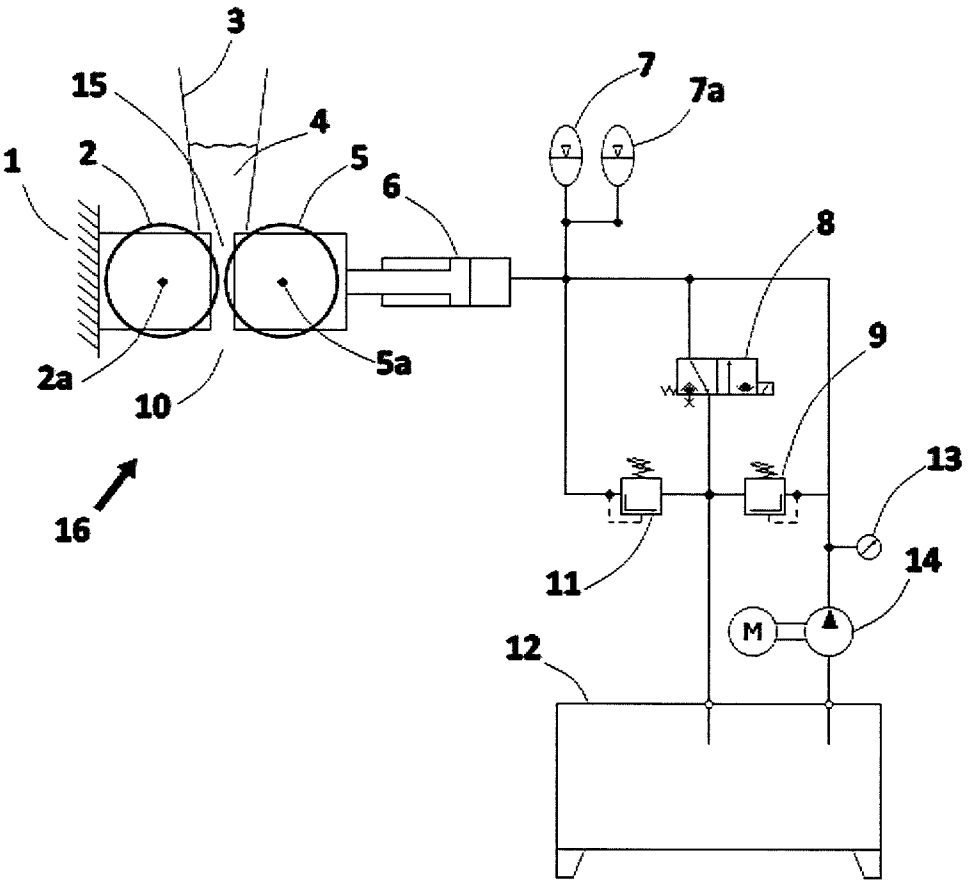
FIG. 1 is a schematic view of a first present preferred embodiment of a roller press with a control valve shown in an open position.
Figure 2:
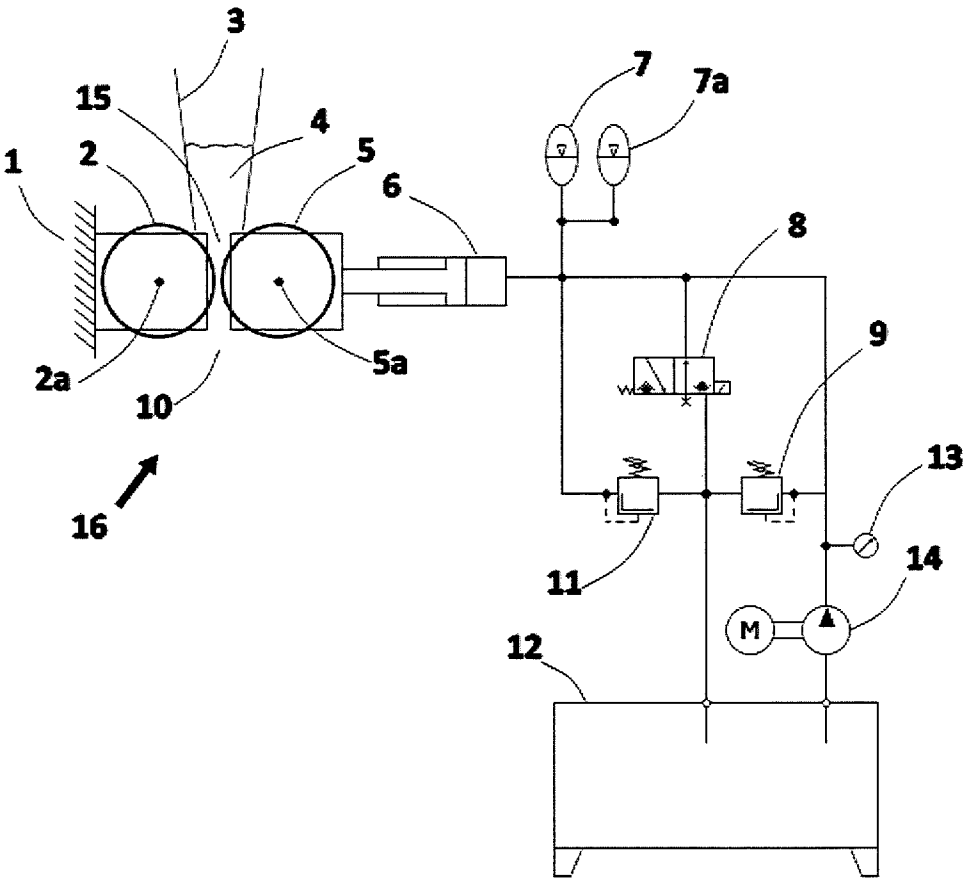
FIG. 2 is a view similar to FIG. 1 of the first present preferred embodiment of the roller press with the control valve shown in a closed position.

Referring to FIGS. 1-2, a roller press 16 may include a frame 1. A fixed first roller 2 may be attached to the frame. The first roller 2 is rotatable to comminute material. A second moveable roller 5 is positioned so that it is spaced apart from the fixed first roller 2 and is moveable to adjust a position of the second roller 5 relative to the first roller 2. The second roller 5 is also rotatable to comminute material.

The space between the first roller 2 and the second roller 5 may define a nip 15. The width of the nip may be the distance between the rollers 2 and 5. The width of the nip 15 may be adjusted by movement of the moveable second roller 5 away from or towards the fixed first roller 2.

Material 4 to be crushed, grinded or otherwise comminuted may be fed through the nip via a feed chute 3 or feed opening formed in the frame 1. The material may be agglomerated material, minerals, rock, ore, stone, materials used for the manufacturing of concrete, material used for the manufacturing of cement, or other crushable material or grindable material. After passing through the nip 15, the comminuted material may be outputted via an output 10. That material may be subsequently fed to other crushing mechanisms for further comminution or may be transported from the roller press for other processing.

A hydraulic cylinder 6 may be attached to the frame 1. The hydraulic cylinder 6 may attached the frame 1 to the moveable roller 5. Movement of a moveable element, such as a piston, may be configured to move the moveable roller 5 for adjusting the position of the roller 5 and width of the nip 15. The moveable element of the hydraulic cylinder 6 may move in a direction that is perpendicular or substantially perpendicular to the axis of rotation 2*a* of the first roller 2, an axis of rotation 5*a* of the second roller 5, or the axes of rotation 2*a* and 5*a* of both rollers 2 and 5. For instance, movement of the moveable element of the hydraulic cylinder 6 may occur along a linear path that is aligned at a position 90 degrees relative to an axis of rotation 5*a* or 2*a* or at a position that is 89 degrees or about 85 degrees relative to axis of rotation 5*a* or 2*a*.

The moveable element of the hydraulic cylinder 6 may be caused to move by fluid stored in the hydraulic cylinder, such as oil or hydraulic oil. The fluid may provide a pressure that positions the moveable element in a particular location. As material is comminuted in the nip 15, the amount of force acting on the moveable roller 5 may change so that sufficient force is provided to move the second roller 5 away from the first roller 2. Such movement may cause pressure within the cylinder to increase or may push fluid in the hydraulic cylinder out of the hydraulic cylinder.

At least one accumulator 7 is connected to the hydraulic cylinder 6 such that fluid may move from the hydraulic cylinder 6 to the accumulator 7. Such a connection may be formed via piping or another type of conduit permitting fluid to travel between the hydraulic cylinder 6 and accumulator 7. Of course, fluid may also move from the accumulator 7 to the hydraulic cylinder 6.

At least one spike accumulator 7*a* may also be connected to the hydraulic cylinder or the accumulator 7 such that the fluid may move from the hydraulic cylinder 6 or accumulator 7 to the spike accumulator 7*a*. Such a connection may be formed via piping or another type of conduit permitting fluid to travel between the hydraulic cylinder 6 or accumulator 7 and the spike accumulator 7*a*. Fluid may also move from the spike accumulator 7*a* to the hydraulic cylinder 6 or accumulator 7.

A relief valve 11 may also be connected to the hydraulic cylinder 6 such that fluid may flow from the hydraulic cylinder 6 through the relief valve 11 to a fluid storage tank 12. The relief valve 11 may also be connected to the accumulator 7 and spike accumulator 7*a* so that fluid from the accumulators may pass through the relief valve and into the fluid storage tank 12. Such connections may be formed via piping or another type of fluid conduit connection device.

The relief valve 11 may be moveable from a closed position to an open position. When in the open position, fluid may flow from the hydraulic cylinder or accumulators to the storage tank 12. When the relief valve is in the closed position, fluid may not flow through the relief valve to the storage tank 12.

A control valve 8 may also be connected to the hydraulic cylinder so that fluid may pass from the storage tank 12 to the hydraulic cylinder 6. Such a connection may be provided via piping or other type of fluid conduit mechanism. The control valve 8 may be moveable from an open position which permits fluid to pass from the storage tank to the hydraulic cylinder 6, to a closed position, which prevents fluid from passing from the storage tank to the hydraulic cylinder 6.

A pump 14 may also be connected to the storage tank 12 to move fluid from the storage tank to the hydraulic cylinder 6 or accumulators. Such a connection may be formed via piping or other type of fluid conduit mechanism. A pump release valve 9 may be positioned between the hydraulic cylinder 6 and the pump 14 in case a pressure buildup requiring relief is detected when fluid is being moved from the storage tank 12 to the hydraulic cylinder 6. The pump relief valve 9 may be moved to an open position to relieve such a build up of pressure and permit fluid to be moved back to the storage tank 12 via a fluid conduit mechanism such as piping interconnecting the storage tank 12 to the pump relief valve 9.

A pressure gauge 13 may also be attached to one or more portions of the connectors connecting the different components of the roller press together to monitor the pressure that fluid is under within the roller press. It should be appreciated that the connectors interconnecting the different components so that fluid may flow to or from those components may be pipes or other conduits that permit the fluid to flow from one component to other components. Such piping and the components through which the fluid flows may be part of a fluid system or a fluid circuit for the hydraulic cylinder 6.

The roller press may be configured so that the pressure for the fluid system of the hydraulic cylinder 6 is a certain predetermined level, such as, for example, 1,600 pounds per square inch (psi) or 2,000 psi or 11,032 kPa, or 13,790 kPa. The spike accumulator 7*a* may be set at a predetermined amount higher than this predetermined level so that the spike accumulator 7*a* stays "isolated" during all operational times for the roller press unless an uncrushable element passes through the nip. For example, the accumulator 7 may be set at a pressure value of 1,600 psi for normal operational conditions or for the comminution of crushable material via the rollers 2 and 5, the cylinder may have a pressure setting such as an operational pressure of 2,000 psi and the spike accumulator 7*a* may be set at a pressure of 2,400 so that the spike accumulator is in "isolation" during such normal operational conditions or while only crushable material is being comminuted by passing through the nip 15.

It should be understood that the pressure setting for the accumulator 7 may set the spring rate for the hydraulic cylinder 6. This spring rate may affect how easily the moveable element of the hydraulic cylinder moves in response to material being crushed as it passes through the nip. The spring rate may also affect how the second roller 5 may move in response to the comminution of such material passing through the nip.

Preferably, the operational pressure of the cylinder is a first value and the pressure of the primary accumulator 7 is 50% to 80% of that first value pressure setting of the cylinder. The pressure of the spike accumulator 7*a* may be higher than the operational pressure of the cylinder and higher than the pressure of the primary accumulator. For instance, the spike accumulator 7*a* may have a pressure setting that is 10% to 30% higher than the operational pressure of the cylinder.

Because the spike accumulator 7*a* is in "isolation" during typical operation of the roller press, or typical comminution of crushable material, fluid does not flow from the hydraulic cylinder 6 to the spike accumulator 7*a* when the rollers 2 and 5 are being rotated to crush or comminute crushable material. Nor does fluid flow from the accumulator 7 to the spike accumulator 7*a* when crushable material is being comminuted in the nip.

However, if an uncrushable element passes through the nip 15, a significant amount of pressure is exerted on the moveable roller 5, causing the moveable element of the hydraulic cylinder to be compressed and the moveable second roller 5 to move away from the fixed first roller 2 to widen the nip 15. Such movement also causes fluid to move from the hydraulic cylinder 6 to the spike accumulator 7*a*.

For some uncrushable elements, it is contemplated that fluid may only flow to the spike accumulator 7*a* and that this will be sufficient for releasing the pressure experienced by the accumulator 7 and the hydraulic cylinder 6 while the uncrushable element passes through the nip. In many other cases, the pressure may be so high that the fluid passing to the spike accumulator 7*a* may only provide a temporary relief of pressure as the pressure experienced by the hydraulic cylinder via the presence of the uncrushable element increases. In such cases, the relief valve 11 may subsequently be opened to permit fluid to flow from the hydraulic cylinder 6 to the fluid storage tank 12 to relieve that increased pressure.

In some embodiments of the roller press, the relief valve 11 may be configured to open once fluid begins to flow to the spike accumulator 7*a*. For such embodiments, the fluid circuit of the roller press may be configured such that the movement of fluid to the spike accumulator 7*a* actuates opening of the relief valve 11. Because the spike accumulator 7*a* provides an initial relief of an increase of pressure over the normal operational pressure for the hydraulic cylinder, there is little, if any delay in pressure relief that may occur while the relief valve is moved to the open position. The reduction or elimination of such a delay reduces the pressure certain components of the roller press must experience due to the presence of uncrushable elements passing through the nip 15 and increases the life of the components of the roller press.

After the uncrushable element passes through the nip 15 and is expelled via the outlet 10, the pressure in the fluid system of the roller press may decrease back to the predetermined normal operating pressure value. Fluid may then be pumped from the storage tank 12 to the hydraulic cylinder 6 via pump 14. A control valve may be moved to an open position to permit the pump 14 to pump the fluid from the storage tank 12 to the hydraulic cylinder 6. Fluid may also flow from the spike accumulator 7*a* to the hydraulic cylinder 6 or to the accumulator 7 after the uncrushable element has passed through the nip 15. Fluid may also flow from the accumulator 7 to the hydraulic cylinder 6 after the uncrushable element has passed through the nip. In the event a pressure build up occurs while the pump 14 is activated for moving fluid from the tank 12 to the hydraulic cylinder 6, the fluid system of the roller press may be configured to cause the pump relief valve 9 to open to release this pressure and permit the fluid to move back to the storage tank 12. As may be appreciated by those of skill in the art, an example of such a pressure increase occurring could be the presence of another uncrushable element within the nip 15 while the pump is activated for pumping fluid from the storage tank 12 back to the hydraulic cylinder 6.

It should be appreciated that the elements of the fluid circuit of the roller press may be controlled in any of a number of different conventional ways. For example, a controller may be connected to the elements to control the opening and closing of different valves, detection of certain events, and actuation of different elements, such as the pump 14. Sensors may connect the controller to these elements so the controller is able to detect certain conditions or otherwise monitor the fluid circuit of the roller press for controlling the elements or other portions of the roller press.

It should be understood that uncrushable elements may be any type of object that the rollers are unable to comminute or effectively comminute. For instance, an uncrushable element may be an object composed of tramp metal or a rock or other object composed of very hard material that is much harder than the material the rollers are configured to crush, grind, or otherwise comminute when passing through the nip 15.

Figure 3:
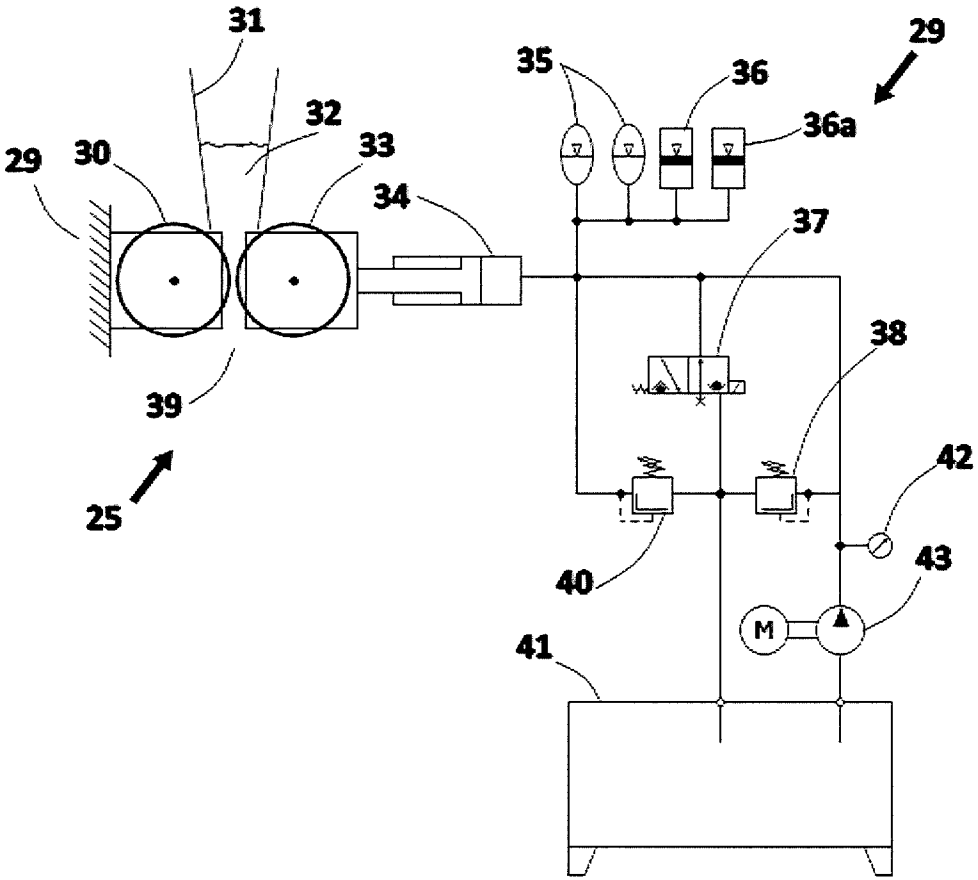
FIG. 3 is a schematic view of a second present preferred embodiment of a roller press with a control valve shown in a closed position.

Referring to FIG. 3, a roller press 25 may include a frame 29 that has a first roller 30 affixed to the frame 29. The first roller may rotate along an axis 30*a* to comminute material. A moveable roller 33 may be positioned adjacent to and spaced apart from the first roller 30. The space between the first and second rollers 30 and 33 may define a nip 27. The second roller 33 may rotate about a rotational axis 33*a*. The rotational axis for each roller may be defined by an axle or other rotational mechanism.

Material fed to the roller press 25 may be comminuted or crushed when passing through the nip 27 as the first and second rollers 30 and 33 rotate about their axes of rotation 30*a* and 33*a*. Material 32 may be fed to the roller press 25 via a feed inlet 31, which may include a feed chute or feed mechanism. Material that has passed through the nip 27 may be expelled from the roller press via an outlet 39 or material discharge mechanism.

A cylinder 34 may be attached to the moveable roller 33 to attach the moveable roller 33 to the frame 29. The cylinder 34 may be a hydraulic cylinder or other actuator. The cylinder 34 may include a piston or other moveable element that is moveable from an extended position to a retracted position. When in the extended position, the moveable roller 33 may be positioned closer to the fixed first roller 30 to narrow the nip 27. When the piston of the cylinder 34 is in the retracted position the moveable roller 33 may be farther from the fixed first roller 30 to widen the nip 27.

The cylinder 34 may include fluid that exerts a pressure on the piston to extend the piston. The normal operational pressure of the fluid may be, for example, 2,000 psi. A force that is greater than the force exerted by the fluid may cause the piston to retract against the fluid and compress the fluid, which may increase the amount of pressure the fluid in the cylinder experiences. Such an increase in pressure may also push some of the fluid out of the cylinder 34 and toward primary accumulators 35 that are connected to the cylinder 34 or to other components of a fluid system 29 or fluid circuit that are connected to the cylinder 34.

Preferably, the fluid is a type of oil or a type of hydraulic oil. Most preferably, the fluid is a type of oil that is commonly used in hydraulic systems for roller presses. Of course, it is contemplated that the fluid could be another type of liquid or even a type of gas in some embodiments.

The primary accumulators 35 are preferably bladder accumulators. The primary accumulators 35 may be set at a desired operational pressure, such as an operational pressure of 1,600 psi. That operational pressure is the pressure at which the roller press 25 is configured to operate at when comminuting crushable material and is configured to help cause the fluid of the cylinder 34 to position the moveable roller 33 to define a nip 27 having a desired width for the crushing of that material. The cylinder 34 may also operate at an operational pressure, such as an operational pressure of 2,000 psi.

A secondary piston accumulator 36 is also connected to the cylinder 34. The secondary piston accumulator 36 is set at a second pressure, such as 2,400 psi, which is substantially higher than the operational pressure setting for the primary accumulators 35 and the cylinder 34. The setting of the secondary piston accumulator 36 is configured to isolate that accumulator so that fluid will not flow from the hydraulic cylinder to the piston accumulator 36 when only crushable material is passing through the nip 27 to be comminuted.

It should be appreciated that additional secondary accumulators such as secondary accumulator 36*a* may also be included in embodiments of the roller press 25. Those additional secondary accumulators may also be set at the pressure setting of the other secondary accumulator 36.

In the event an uncrushable element passes through the nip 27, a great amount of force may be exerted against the second roller 33 to widen the nip 27 and increase the amount of pressure the fluid of the cylinder 34 is under. That pressure may increase well above the operational pressure of the primary accumulators 35 and the cylinder 34 and be sufficiently high for fluid to pass from the cylinder 34 to both primary accumulators 35 and to the secondary piston accumulator 36 and any additional secondary accumulators 36*a*.

For example, the pressure experienced by the fluid of the cylinder 34 may be sufficient for fluid to move from the cylinder 34 to the primary accumulators 35. As fluid is moved to the primary accumulators 35, the pressure within those accumulators 35 may rise to the pressure setting of the secondary accumulator 36 and any additional secondary accumulators 36*a*. When the pressure of the primary accumulators 35 reaches the pressure of the pressure setting for the secondary accumulator 36, fluid may then move from the cylinder 34 to the primary accumulators 35 and the secondary accumulator 36.

A relief valve 40 that is also connected to the cylinder 34 may be configured so that the relief valve 40 is moved to an open position when fluid is detected as flowing to the secondary piston accumulator 36. After the relief valve 40 is opened, fluid may flow to a storage tank 41 connected to the relief valve 40 via piping to reduce the pressure building up within the fluid system of the roller press. The secondary piston accumulator 36 may provide an intermediate relief for the increase in pressure caused by the uncrushable element passing through the nip until the relief valve is opened to fully relieve the pressure increase.

Such an intermediate pressure relief mechanism may permit the relief valve 40 to be smaller in size and cost than conventional relief valves used in conventional roller presses. A use of such a smaller relief valve may help reduce the cost for manufacturing a roller press. Further, such an intermediate pressure relief mechanism can avoid different components in the fluid system 29 having to experience excessive pressures, which may help increase the life of those components and reduce costs associated with the maintenance and repair of those components. This may help reduce the costs associated with operating and maintaining the roller press and provide a cost savings to purchasers or users of embodiments of the roller press.

After the relief valve 40 has been opened, fluid may flow from the cylinder 34 to the storage tank 41. After the uncrushable element has passed through the nip or the increase in pressure has receded due to the passing of that uncrushable element, a control valve 37 may be moved from a closed position to an open position to permit a pump 43 to move fluid from the storage tank 41 to the cylinder 34. A pump relief valve 38 may be positioned between the cylinder and the control valve. The pump relief valve 38 may operate similarly to pump relief valve 9 discussed above.

After a sufficient amount of fluid has been moved from the storage tank 41 to the cylinder 34, the control valve 37 may move to a closed position and the pump 43 may be deactivated.

Figure 4:
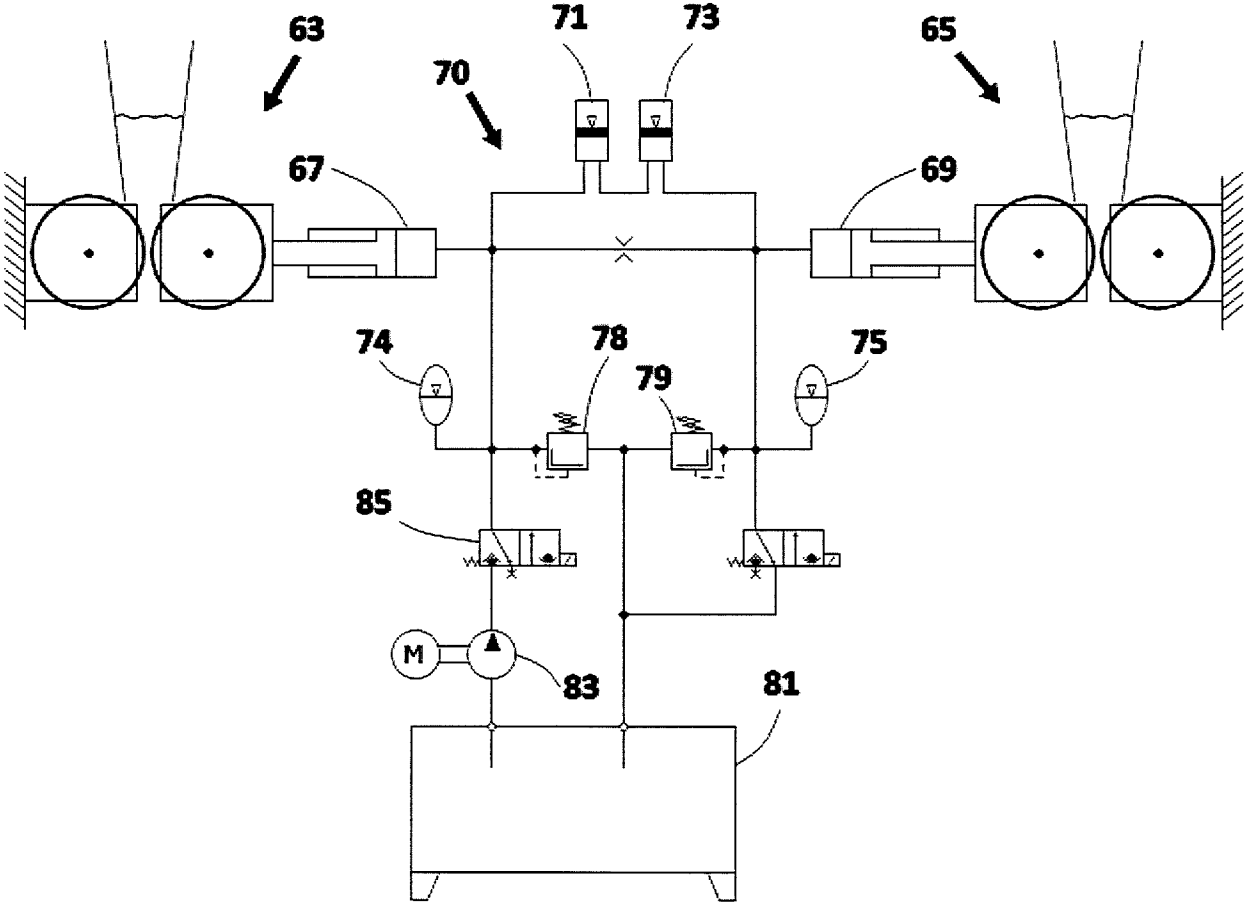
FIG. 4 is a schematic view of a third present preferred embodiment of a roller press.

Referring to FIG. 4, a tandem roller press 61 may include two pairs or rollers 63 and 65. Each pair of rollers may include a fixed roller 63*a*, 65*a* and a moveable roller 63*b*, 65*b* spaced apart from the fixed roller to form a nip between the two rollers. A respective hydraulic cylinder 67 or 69 may attach each moveable roller to the frame of the roller press.

The roller press may also include a fluid circuit 70 or fluid system. The fluid circuit 70 may include the hydraulic cylinders 67, 69 and other components that may be interconnected together for fluid to pass to and from those components. The fluid circuit 70 may include primary accumulators 74 and 75 connected to respective hydraulic cylinders 67 and 69 and may also include respective secondary accumulators 71 and 73 connected to respective cylinders 67 and 69. Respective relief valves 78 and 79 may be connected to respective hydraulic cylinders 67 and 69 as well. Each relief valve 78 and 79 may be connected to a respective storage tank or may connect to the same fluid storage tank 81.

As with the fluid systems discussed above with reference to roller presses 25 and 16, the secondary accumulators may be set at a pressure that is higher than the pressure settings of the primary accumulators and higher than the operational pressure for the cylinders to which they are attached. For instance, the cylinders 67 and 69 may have operational pressures of 2,400 psi, the primary accumulators 74 and 75 may have pressure settings of 2,000 psi and the secondary accumulators 71 and 73 may have pressure settings of 2,800 psi. Preferably, the secondary accumulators have a pressure setting such that they only receive fluid from the cylinder to which they are attached when an uncrushable element passes through a nip to create an event that greatly increases the pressure exerted on the fluid.

Each relief valve 78 and 79 may be configured to move from a closed position preventing fluid from passing to the storage tank 81 to an open position permitting fluid to move to the storage tank 81 when fluid flowing to a respective secondary accumulator is detected. For instance, relief valve 78 may be configured to move to the open position when fluid flowing to the secondary accumulator 71 is detected by a sensor or other detection mechanism. As another example, relief valve 79 may be configured to move to the open position when fluid flowing to secondary accumulator 73 is detected.

The relief valves may utilize one or more logic cartridge valves for detecting a pressure spike or fluid passing to a secondary accumulator to actuate opening of that relief valve. Of course, other types of detecting mechanisms used for controlling and monitoring the flow of fluid throughout the fluid circuit 70 may also be used.

A pump 83 may also be included in the fluid circuit 70. The pump 83 may be connected to the storage tank 81 and be configured to pump fluid from the storage tank to either cylinder 67 or 69. A control valve 85 may also be included in the fluid circuit and may be configured to move from a closed position to an open position to permit fluid to be pumped from the storage tank 81 to either cylinder 67 or 69. A pump relief valve (not shown) may also be included for relieving pressure spikes that may occur when the pump is activated. In some embodiments, there may be multiple control valves, multiple pumps and multiple pump relief valves so that there is a respective control valve, pump and pump relief valve for moving fluid to each respective cylinder 67 or 69. The control valves, pumps and pump relief valves may operate and function similarly to the control valves, pumps and pump relief valves discussed above with reference to FIGS. 1-3.

The secondary accumulators 71 and 73 may also be interconnected so that each accumulator may also receive fluid from the other secondary accumulator. Such a configuration may permit both secondary accumulators to receive fluid from both cylinders 67 and 69 in the event an uncrushable element passes through a nip formed between either pair of rollers 63 or 65. For such embodiments, it should be understood that the secondary accumulators 71 and 73 may serve as secondary accumulators for both cylinders 67 and 69.

The above discussed embodiments provide examples of various aspects of comminution devices. It should be appreciated by those of at least ordinary skill in the art that various alterations may be made to the embodiments discussed above. For instance, the size, shape or configuration of the rollers, accumulators, relief valves, or storage tanks may be any of a number of possible options to meet a particular design objective. Similarly, the operational pressure for the cylinders and pressure settings for the accumulators of the roller press may be any of a number of pressures, range of pressures or pressure settings to meet a particular design objective. As another example, the types of accumulators used may be any of a number of accumulator types such as, for example, hydro-pneumatic accumulators, piston accumulators, gas charged bladder accumulators, gas charged piston accumulators, spring loaded piston accumulators, weight loaded accumulators, or gas valve accumulators.

While certain present preferred embodiments of devices that are configured to comminute material and methods of making and using the same have been shown and described above, it is to be distinctly understood that the invention is not limited thereto but may be otherwise variously embodied and practiced within the scope of the following claims.

What is claimed is:

1. A roller press comprising:

a frame;

a first roller attached to the frame;

a second roller positioned adjacent to the first roller such that a nip is formed between the first and second rollers;

the first and second rollers being rotatable to comminute material that passes through the nip;

a fluid circuit comprising a first cylinder moveably attaching the second roller to the frame, a first primary accumulator, and a first secondary accumulator which is isolated from the first cylinder and first primary accumulator until an uncrushable element passes through the nip; the first secondary accumulator being kept at a pressure greater than the first cylinder and the first primary accumulator the first cylinder having a moveable element attached to the second roller and a fluid, the fluid being moveable to move the moveable element for adjusting a position of the second roller relative to the first roller;

the first primary accumulator being connected to the first cylinder such that at least a portion of the fluid is moveable from the first cylinder to the first primary accumulator when the first and second rollers are rotated to comminute crushable material; the first secondary accumulator also being connected to the first cylinder;

the fluid circuit further comprising a second cylinder, a second primary accumulator, and a second secondary accumulator; the second secondary accumulator being kept at a pressure greater than the second cylinder and the second primary accumulator; the second secondary accumulator being isolated from the second cylinder and second primary accumulator in the absence of an uncrushable element;

the second primary accumulator being connected to the second cylinder such that at least a portion of the fluid in the second cylinder is moveable from the second cylinder to the second primary accumulator; the second secondary accumulator also being connected to the second cylinder;

wherein the second roller is configured to move away from the first roller when fluid moves from the first cylinder to the first secondary accumulator to widen the nip and the second roller is configured to be movable toward the first roller to narrow the nip; and, wherein fluid is not moved from the first cylinder to the first secondary accumulator when the crushable material is being comminuted and an uncrushable element is not passing through the nip.

2. The roller press of claim 1 further comprising a fluid storage tank connected to the first cylinder to receive fluid from the first cylinder, fluid stored in the fluid storage tank also being moveable from the fluid storage tank to the first cylinder;

a relief valve positioned between the first cylinder and the fluid storage tank, the relief valve moveable from a closed position to an open position, at least a portion of the fluid from the first cylinder being moveable to the fluid storage tank when the relief valve is in the open position.

3. The roller press of claim 2 further comprising a pump connected to the fluid storage tank to move fluid stored in the fluid storage tank toward the first cylinder.

4. The roller press of claim 3 wherein the relief valve is configured to move to the open position when the uncrushable element is detected as being within the nip and the pump is configured to be activated after at least a portion of the fluid from the first cylinder has been received by the fluid storage tank via the relief valve when an uncrushable element passed through the nip so that fluid stored in the storage tank is moved to the first cylinder after the uncrushable element has passed through the nip.

5. The roller press of claim 4 further comprising a control valve moveable from a closed position to an open position, fluid stored in the fluid storage tank being moveable from the fluid storage tank to the first cylinder when the control valve is in the open position and fluid not being moveable from the fluid storage tank to the first cylinder when the control valve is in the closed position.

6. The roller press of claim 5 wherein the crushable material is ore, rock, minerals, stone, agglomerated material or combinations thereof, the first primary accumulator is a hydraulic accumulator, the first secondary accumulator is a hydraulic accumulator and the first cylinder is a hydraulic cylinder.

7. The roller press of claim 5 wherein fluid of the second cylinder is not moved from the second cylinder to the second secondary accumulator when crushable material is being comminuted and an uncrushable element is not present.

8. The roller press of claim 1, wherein the first primary accumulator is set at a second pressure setting that is below a first pressure setting of the first cylinder; and wherein the first secondary accumulator which is connected to the first cylinder is at a third pressure setting that is greater than the first pressure setting of the first cylinder and is greater than the second pressure setting of the first primary accumulator.

9. The roller press of claim 8 wherein the second pressure setting is between 10% and 30% lower than the first pressure setting.

10. The roller press of claim 8 wherein the third pressure setting is between 10% and 30% higher than the first pressure setting.

11. The roller press of claim 8 wherein the second pressure setting is between 10% and 30% lower than the first pressure setting and wherein the third pressure setting is between 10% and 30% higher than the first pressure setting and wherein the first pressure setting is a pressure set point, the second pressure setting is a pressure set point and the third pressure setting is a pressure set point.

12. The roller press of claim 8 wherein: the second cylinder is at a fourth pressure setting;

the second primary accumulator being set at a fifth pressure setting that is below the fourth pressure setting of the second cylinder; and the second secondary accumulator being at a sixth pressure setting that is greater than the fourth pressure setting of the second cylinder and is greater than the fifth pressure setting of the second primary accumulator.

13. The roller press of claim 12 wherein the second secondary accumulator is connected to the first secondary accumulator.

14. The roller press of claim 12 wherein the third pressure setting is equal to the first pressure setting, the second pressure setting is equal to the fifth pressure setting, and the third pressure setting is equal to the sixth pressure setting.

15. The roller press of claim 8 wherein the second pressure setting is between 10% and 50% lower than the first pressure setting or is a value between 80% of the first pressure setting and 50% of the first pressure setting.

* * * * *